US009159254B2

(12) United States Patent
Oyoung

(10) Patent No.: US 9,159,254 B2
(45) Date of Patent: Oct. 13, 2015

(54) TRUCK MOUNTED FLAG AND POLE ASSEMBLY

(76) Inventor: Glenn Kai Oyoung, Arcadia, CA (US)

( * ) Notice: Subject to any disclaimer, the term of this patent is extended or adjusted under 35 U.S.C. 154(b) by 884 days.

(21) Appl. No.: 13/164,680

(22) Filed: Jun. 20, 2011

(65) Prior Publication Data

US 2012/0318189 A1 Dec. 20, 2012

(51) Int. Cl.
*G09F 17/00* (2006.01)

(52) U.S. Cl.
CPC ..... *G09F 17/00* (2013.01); *G09F 2017/0066* (2013.01); *G09F 2017/0075* (2013.01)

(58) Field of Classification Search
CPC ..... B60R 9/00; G09F 17/00; G09F 21/04; G09F 2017/0075; G09F 2021/04
USPC ..... 116/28 R, 173, 174, 175; 40/590, 591, 40/592; 224/402, 403, 404, 405, 549, 550, 224/551, 557; 248/503; 296/3; 362/477, 362/485, 493, 496; 410/110, 151; D11/166, D11/182, 183
See application file for complete search history.

(56) References Cited

U.S. PATENT DOCUMENTS

| | | | | | |
|---|---|---|---|---|---|
| 3,240,455 | A | * | 3/1966 | Swezy et al. | 248/539 |
| 4,363,084 | A | * | 12/1982 | Dimiceli | 362/249.01 |
| 4,737,056 | A | * | 4/1988 | Hunt | 410/151 |
| 4,833,443 | A | | 5/1989 | Siew | |
| 4,875,431 | A | * | 10/1989 | Dobosz | 116/173 |
| 4,967,685 | A | * | 11/1990 | Beck | 116/173 |
| 4,977,849 | A | | 12/1990 | Brinton | |
| 4,995,537 | A | * | 2/1991 | Thedieck | 224/547 |
| 5,127,564 | A | * | 7/1992 | Romero | 224/403 |
| 5,233,938 | A | | 8/1993 | Lalo | |
| 5,411,191 | A | * | 5/1995 | Bunn, Jr. | 224/403 |
| 5,463,974 | A | | 11/1995 | Seeder | |
| 5,605,264 | A | * | 2/1997 | Neal | 224/404 |
| 5,611,472 | A | * | 3/1997 | Miller | 224/403 |
| 5,732,927 | A | | 3/1998 | Purpura | |
| D411,484 | S | | 6/1999 | Hill | |
| 5,995,053 | A | | 11/1999 | Curtis | |
| 6,179,181 | B1 | * | 1/2001 | Johnson et al. | 224/405 |
| 6,290,441 | B1 | | 9/2001 | Rusu | |
| 6,309,006 | B1 | | 10/2001 | Rippberger | |
| 6,394,326 | B1 | * | 5/2002 | Lanier | 224/405 |
| D464,912 | S | | 10/2002 | Powell | |
| 6,468,009 | B2 | * | 10/2002 | Elwell et al. | 410/107 |
| 6,505,764 | B2 | * | 1/2003 | Vining et al. | 224/405 |
| 6,557,483 | B2 | | 5/2003 | Nathan | |

(Continued)

FOREIGN PATENT DOCUMENTS

AU 781569 B2 * 6/2005

*Primary Examiner* — Richard A Smith

(57) ABSTRACT

A flag and pole mounting assembly for attaching a flagpole to a vehicle includes a middle shaft extending substantially between two sidewalls of the vehicle and adjustable endshafts for extending the total length of the mounting assembly. Posts at each end of the middle shaft engage with stake pockets located in the two sidewalls of the vehicle. A flagpole attachment member couples to the middle shaft and defines a cavity for receiving and securing the flagpole to the middle shaft. A light source connected to the flagpole attachment member illuminates the flagpole or an associated flag when the flagpole is coupled to the flagpole attachment member. A solar panel or other power source is electrically connected to the light source for powering the light source. The mounting assembly may only utilize one stake pocket or may engage with the sidewalls of the vehicle without use of any stake pockets.

16 Claims, 11 Drawing Sheets

(56) References Cited

U.S. PATENT DOCUMENTS

| | | | | |
|---|---|---|---|---|
| D475,677 | S | 6/2003 | Zucker | |
| 6,637,718 | B2 * | 10/2003 | Wilson | 248/539 |
| 6,732,984 | B2 * | 5/2004 | Tsai | 248/125.1 |
| 6,739,084 | B1 * | 5/2004 | Hansen et al. | 43/21.2 |
| 6,802,633 | B1 * | 10/2004 | VandenBossche | 362/477 |
| 6,808,098 | B1 | 10/2004 | Bickett, III et al. | |
| 6,955,456 | B2 | 10/2005 | Schroeder | |
| 6,969,219 | B2 | 11/2005 | Speece et al. | |
| 7,017,511 | B2 | 3/2006 | Fisher et al. | |
| 7,121,585 | B2 * | 10/2006 | Cole | 280/748 |
| D564,595 | S | 3/2008 | Barrett | |
| D578,057 | S | 10/2008 | Frenock | |
| D578,442 | S | 10/2008 | Oakley | |
| D592,110 | S | 5/2009 | Oakley | |
| 7,594,478 | B2 | 9/2009 | Karnes et al. | |
| 7,878,139 | B1 | 2/2011 | Karnes et al. | |
| 8,474,767 | B1 * | 7/2013 | Nicholls | 248/200.1 |
| 8,668,124 | B2 * | 3/2014 | Kennedy et al. | 224/403 |
| 2006/0114684 | A1 * | 6/2006 | Marquez | 362/487 |
| 2011/0179692 | A1 * | 7/2011 | McKnight et al. | 43/21.2 |
| 2011/0272552 | A1 * | 11/2011 | Jeffries | 248/535 |

* cited by examiner

TRUCK MOUNTED FLAG AND POLE ASSEMBLY

BACKGROUND

1. Field

The present invention relates generally to assemblies for attaching objects to vehicles and improvements thereof. More particularly, the present invention relates to mounting assemblies for attaching flagpoles to trucks and improvements thereof.

2. Description of the Related Art

In the field of automobile attachment assemblies, a variety of designs and structures exist for fastening various objects to an exterior or interior of a vehicle. Assemblies for fastening signage, lighting elements, antennas, hitches, placards, flags or other objects have been designed for mounting upon vehicles of various shapes and sizes. Many vehicle owners, particularly for patriotic reasons or to showcase their support for favorite sports organizations, desire to display a flag upon their automobile. Trucks provide a favorable structure for flag attachment due to their generally large chassis assemblies and truck bed storage areas where blocking visibility out of a cabin window is less of a concern than for automobiles.

Truck bed sidewalls often include one or more holes that provide access to enclosed areas within the truck chassis, known as stake holes or stake pockets. Certain designs have used these stake pockets to provide a secure attachment mechanism for a mounting assembly used to fasten an object to the truck bed side wall. These mounting assemblies may also be attached semi-permanently, for example, with screws or bolts, when positioned within the stake pockets for increased stability. Other designs have instead focused on vacuum-based or alternative fastening methods, such as roof-mounted suction cups or window-mounted clamps. Those who desire a longer lasting solution may alternatively opt for a more permanent design that requires drilling or puncturing into the body of the vehicle in order to fasten the object with screws, adhesives or clamps to the automobile chassis.

While current flagpole mounting systems exist in the prior art, such systems are often made for small, lightweight flags or are difficult to install or maintain. Current systems may even require permanent alterations to the vehicle, increasing the chances for expensive damage or repair costs when removing the system or potentially hurting the resale value of the vehicle. Thus, current systems do not adequately meet the needs of individuals who desire an inexpensive and removable, yet secure, flagpole mounting system, particularly those individuals who desire a mounting assembly or system that can securely fasten one or more of larger or heavier objects to vehicles without requiring permanent alterations to the vehicle chassis. Ideally, the mounting assembly would utilize the stake pockets, sidewalls, or back side behind the cab/rear window of a truck bed for attaching the mounting assembly to the vehicle. In order to accommodate the wide variety of vehicles available for purchase with a wide variety of dimensions, the mounting assembly should also be adjustable so that costly individual engineering or manufacturing of the assemblies for specific vehicle types is avoided. An ideal mounting assembly should be safe to both the owner of the vehicle on which it is installed and to owners of other vehicles that may be in the vicinity of such a vehicle on the roadway. Hence, the mounting assembly should be configured to securely couple to the vehicle and adequately hold the mounted object during vehicle movement or during a crash.

Safety is of particular importance for commercial vehicles available today with ever-increasing engine performance and vehicle speed capabilities.

An ideal mounting assembly should also be practical for everyday use. Thus, the mounting assembly should be easy to both install and to remove by the owner of the vehicle. The mounting assembly should also be difficult for casual thieves to steal flags already attached to the mounting assembly without requiring the owner to un-mount the mounting assembly and store it elsewhere when the vehicle is parked or unattended. Finally, an ideal mounting assembly should also minimize the amount of storage area taken up by the mounting assembly and should also provide illumination to any attached flagpole. In addition to aesthetic reasons, those individuals desirous of flying the American flag on their vehicle for patriotic reasons need a form of illumination upon the flag in order to comply with the flag display requirements during the hours of darkness specified by Title 4, Chapter 1, Section 6 of the U.S. Code.

SUMMARY

An assembly for mounting a flagpole to a vehicle is disclosed. In one embodiment, a flag and pole mounting assembly includes a middle shaft having a first portion and a second portion, the middle shaft configured to extend substantially between a first sidewall and a second sidewall of a vehicle. At least one flagpole attachment member is coupled to the middle shaft between the first portion and the second portion, the flagpole attachment member defining an opening for receiving a flagpole.

The flag and pole mounting assembly may also include a first endshaft, a second endshaft, a first post and a second post. The first endshaft has a connecting portion coupled to the first portion of the middle shaft and an end portion. The second endshaft has a connecting portion coupled to the second portion of the middle shaft and an end portion. The first post couples to the end portion of the first endshaft and is configured to engage with a first stake pocket located in the first sidewall of the vehicle. Similarly, the second post couples to the end portion of the second endshaft and is configured to engage with a second stake pocket located in the second sidewall of the vehicle. Moreover, a light source and a solar panel may be utilized to illuminate a flag when a flagpole is positioned in the flagpole attachment member.

In another embodiment, a flag and pole mounting assembly includes a middle shaft having a first portion and a second portion, the middle shaft configured to extend substantially between a first sidewall and a second sidewall of a vehicle. A first endshaft has a connecting portion coupled to the first portion of the middle shaft and an end portion. Similarly, a second endshaft has a connecting portion coupled to the second portion of the middle shaft and an end portion. A first bracket couples to the first endshaft via a first threaded component and is configured to contact the first sidewall of the vehicle. Likewise, a second bracket couples to the second endshaft via a second threaded component and is configured to contact the second sidewall of the vehicle. A flagpole attachment member couples to the middle shaft between the first portion and the second portion of the middle shaft, the flagpole attachment member defining an opening to receive the flagpole.

In still another embodiment, a flag and pole mounting assembly includes a shaft and a post coupled to the shaft. The post is configured to be received within a cavity of a vehicle. A flagpole attachment device is coupled to the shaft and defines an opening for receiving a flagpole, the flagpole attachment member adjustably oriented around a perimeter of the shaft.

BRIEF DESCRIPTION OF THE DRAWINGS

Other systems, methods, features, and advantages of the present invention will be or will become apparent to one with skill in the art upon examination of the following figures and detailed description. It is intended that all such additional systems, methods, features, and advantages be included within this description, be within the scope of the present invention, and be protected by the accompanying claims. Component parts shown in the drawings are not necessarily to scale, and may be exaggerated to better illustrate the important features of the present invention. In the drawings, like reference numerals designate like parts throughout the different views, wherein:

DETAILED DESCRIPTION

Figure 1:
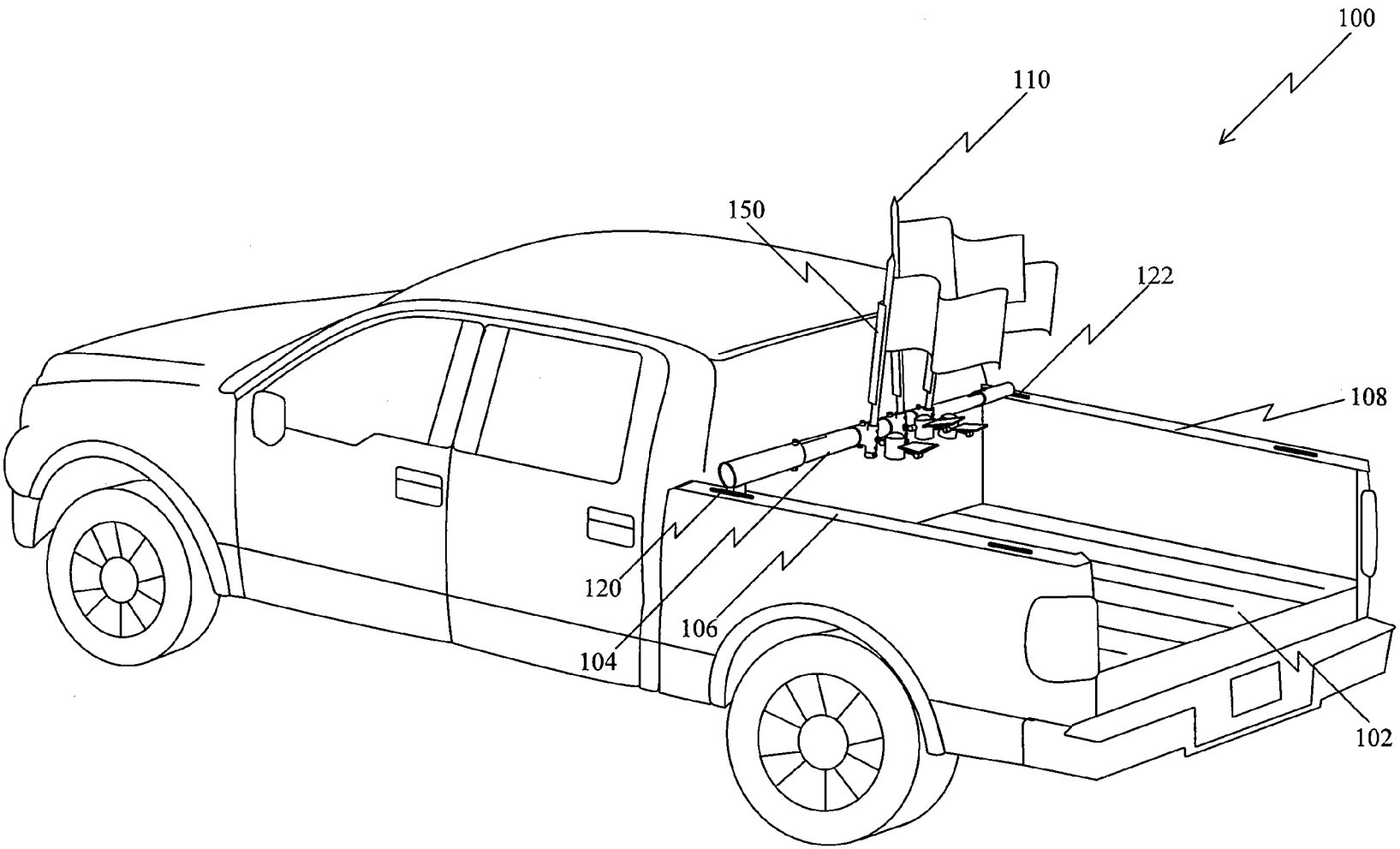
FIG. 1 is a view of a truck having a flag and pole assembly mounted across a truck bed according to an embodiment of the present invention.

FIG. 1 shows a truck 100 with a flagpole 110 coupled thereto. The truck 100 includes a truck bed 102 partly defined by two sidewalls positioned along two outer edges of the truck bed 102. A flag and pole mounting assembly 104 for receiving the flagpole 110 is positioned and extends substantially across the truck bed 102 between the two sidewalls. The first sidewall 106 contains a first stake pocket 120. Similarly, the second sidewall 108 contains a second stake pocket 122. The first stake pocket 120 and the second stake pocket 122 provide access to an interior volume of the first sidewall 106 and the second sidewall 108, respectively. The flag and pole mounting assembly 104 is coupled to the first sidewall 106 and to the second sidewall 108 as discussed in greater detail herein. Hence, the flagpole 110 is secured or attached to the truck 100 via the flag and pole mounting assembly 104. While the truck 100 is preferably shown, in another embodiment a different type of motor vehicle (car, boat, etc.) or other mobile or stationary structure may accommodate the flag and pole mounting assembly 104 for attaching the flagpole 110 thereto. Furthermore, other objects may be mounted in place of or in addition to flagpoles (e.g. light vehicles, animals, fishing equipment). Additionally, a wind deflector 150 having a wedged shape couples to the flagpole 110 for directing or controlling a flow of air around the flagpole 110 to better increase stability when the truck 100 is in motion. In another embodiment, the wind deflector 150 may be formed of various shapes or sizes or fasten to the flag and pole mounting assembly 104 instead of the flagpole 110. In still another embodiment, the wind deflector 150 may not be included in order to reduce drag forces, depending on the angle of the flagpole 110.

Figure 2:
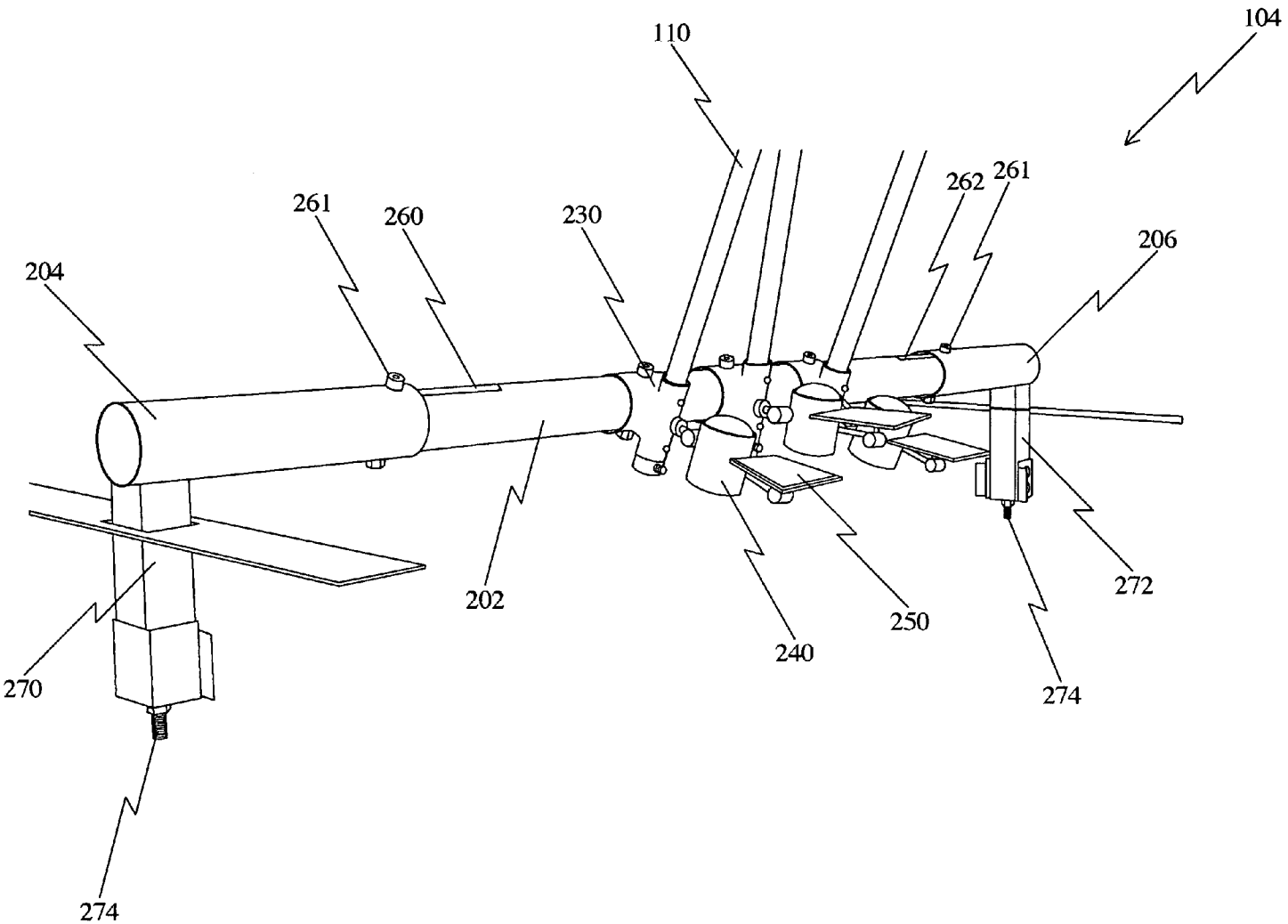
FIG. 2 is a perspective view of the flag and pole assembly shown in FIG. 1 according to an embodiment of the present invention.

Referring now to FIG. 2, a perspective view of an embodiment of a flag and pole mounting assembly 104 is shown. The mounting assembly 104 is preferably configured for attachment to a truck 100 and across a truck bed 102 between two sidewalls, for example, as shown by the flag and pole mounting assembly 104 in FIG. 1. The mounting assembly 104 includes a middle shaft 202 having sufficient length to substantially extend between the two sidewalls of the truck 100 (see FIG. 1). The middle shaft 202 is substantially cylindrical. In an alternative embodiment, the middle shaft 202 may be formed in other shapes or profiles. Preferably, in order to accommodate a variety of truck sizes or dimensions, the middle shaft 202 includes a connecting portion or component which is adjustably connectable with other components of the mounting assembly 104, as discussed in greater detail below. In another embodiment, the mounting assembly 104 may be specifically designed for an application with predetermined dimensions and thus the middle shaft 202 may be fixed in length and without adjustable connection to other components.

At one end of the middle shaft 202, a first slot 260 extends along a first portion of the middle shaft 202. A first endshaft 204, defining a cavity for receiving the middle shaft 202, is configured to slide along and couple with the first slot 260 of the first portion of the middle shaft 202 via a bolt or other fastener 261. Hence, the first endshaft 204 is permitted to connect with the middle shaft 202 at a variety of positions along the first slot 260, providing an adjustable extension of the total length of the mounting assembly 104. A similar connection is made at the other end of the middle shaft 202. A second slot 262 extends along a second portion of the middle shaft 202 and a second endshaft 206 defining a cavity therein couples with the second slot 262 of the second portion of the middle shaft 202 via a bolt or other fastener 261. By altering the connection location via the fasteners 261 of the first or second endshafts 204 or 206 along the first or second portions of the middle shaft 202, the mounting assembly 104 is adjustable to fit a variety of truck shapes or sizes.

A wide variety of attachment mechanisms may be employed to adjustably couple the endshafts 204 or 206 to the middle shaft 202. In one example, the first slot 260 or the second slot 262 may be manufactured as a plurality of discrete holes rather than as a continuous slot or channel, the fasteners 261 each engaging with these discrete holes to achieve a desired total length for the mounting assembly 104 or for coupling the endshafts 204 or 206 at a variety of rotated positions to the middle shaft 202. In another example, the first slot 260 or the second slot 262 may instead extend along the first or second endshafts 204 or 206 instead of along the middle shaft 202. The first or second endshafts 204 or 206 may also slide within an interior of the middle shaft 202 rather than along the exterior surface. Moreover, other fastening methods may be employed in place of or in addition to the fasteners 261 described above to adjustably mount the first endshaft 204 or the second endshaft 206 to the middle shaft 202. In still another embodiment, the middle shaft 202 itself may be adjustable in length, thereby eliminating the need for adjustable connection portions or endshafts.

A first post 270 is connected to the first endshaft 204. With reference to FIG. 1, the first post 270 is configured to fit within the first stake pocket 120 of the sidewall 106. Likewise, a second post 272 is connected to the second endshaft 206 and is configured to fit within the second stake pocket 122 of the sidewall 108. The middle shaft 202 thus substantially extends across the truck bed and between the two sidewalls. The first post 270 is configured to fasten to an interior surface (e.g. on the bottom or on the sides of the stake pocket 120) or component of the sidewall 106 when positioned within the stake pocket 120 via a screw, bolt or other fastener 274 in order to secure the post to the sidewall and stabilize the mounting assembly 104 to the truck. The second post 272 is similarly adapted to fasten to an interior surface or component of the sidewall 108 when positioned within the stake pocket 122 via a screw, bolt or other fastener 274. Thus, the mounting assembly 104 can be securely mounted to the truck to provide a stable base for the attachment of other mounting assembly 104 components. In an alternative embodiment, the first or second posts 270 or 272 may be adapted to couple with the stake pockets 120 or 122 without being additionally fastened within the interior of the sidewalls 106 or 108.

Three flagpole attachment members 230 are coupled to the middle shaft 202 between the first portion and the second portion of the middle shaft 202. An alternative embodiment may utilize greater or fewer flagpole attachment members 230. The flagpole attachment member 230 is connected to the middle shaft 202 via a bolt or screw that passes through an interior of the middle shaft 202, as discussed in greater detail in FIG. 3. The flagpole attachment member 230 defines a cavity for receiving a flagpole 110. The flagpole 110 may be the flagpole 110 as seen in FIG. 1. The flagpole 110 slides into the cavity of the flagpole attachment member 230 and is secured to the flagpole attachment member 230 as described in more detail in FIG. 3.

Additionally, a light source 240 is coupled to the flagpole attachment member 230 and directs light toward the flagpole 110 for illumination. In another embodiment, the light source 240 may be coupled to the middle shaft 202 or another component of the mounting assembly 104 or the vehicle so long as the light source 240 can illuminate the flagpole 110, an associated flag or the truck bed itself. In still another embodiment, no light source 240 may be incorporated at all. The light source 240 comprises one or more LEDs in order to provide ample lighting with minimal power consumption. Other types of light sources may be used in alternative embodiments, for example neon or incandescent bulbs. Various colored bulbs or bulb covers may be employed to illuminate the attached flagpole 110 or associated flag with a variety of different colors, hues or tints. A solar panel 250 is coupled to and electrically connected with the light source 240 to provide power for illuminating the flagpole 110. The solar panel 250 may be coupled to another component of the mounting assembly 104 in another embodiment. Alternatively, a battery may be used in place of or in addition to the solar panel 250. In still other embodiments, the light source 240 may be configured to electrically connect with the truck or vehicle's electrical system or battery, thereby eliminating the need for any additional power components.

Figure 3:
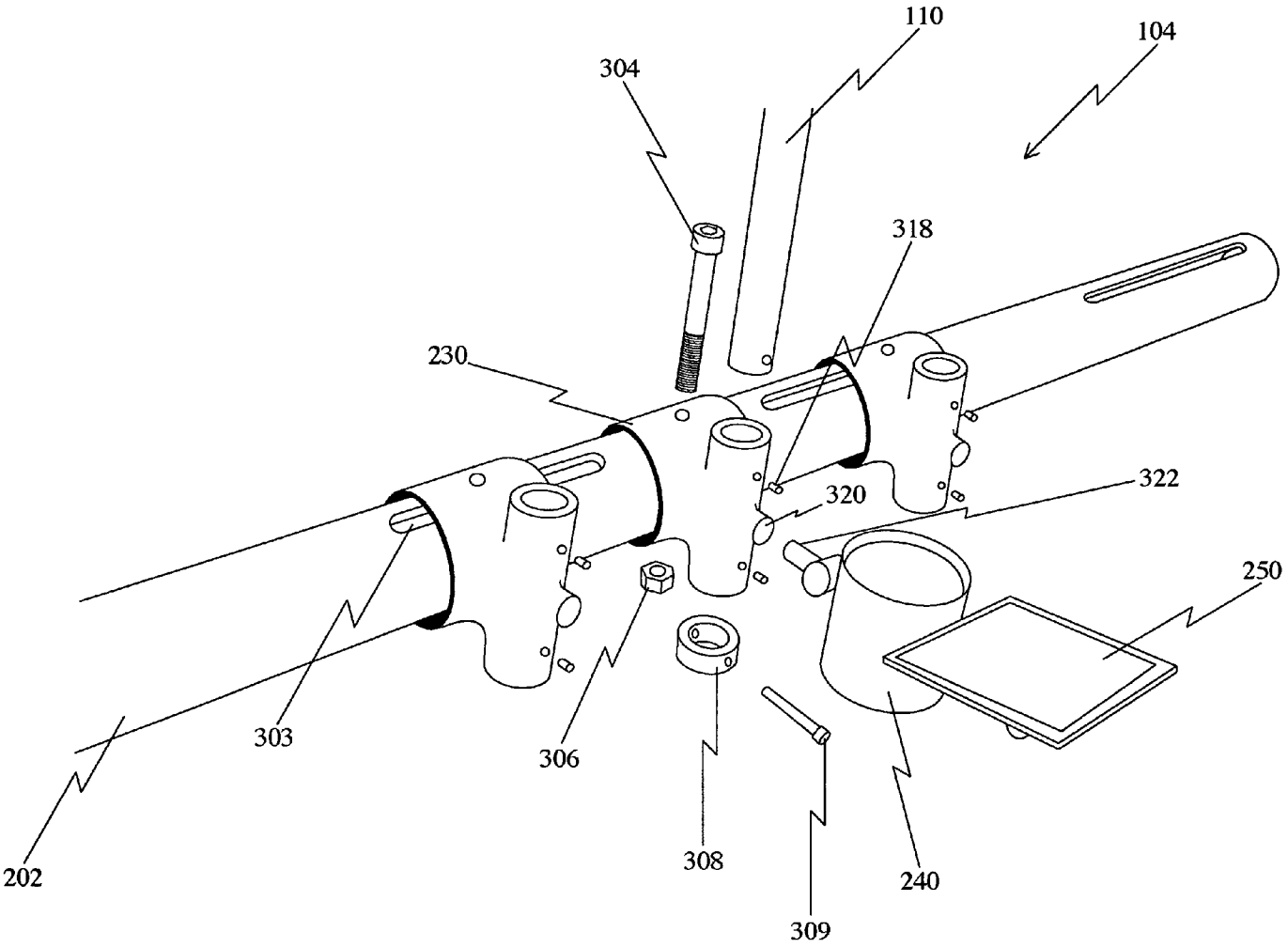
FIG. 3 is an exploded and zoomed perspective view of the flag and pole assembly shown in FIG. 1 according to an embodiment of the present invention.

FIG. 3 shows an exploded and zoomed perspective view of a middle shaft 202 of a mounting assembly 104 and demonstrates one embodiment for attaching a flagpole 110 to a vehicle. The middle shaft 202 couples with a flagpole attachment member 230, a light source 240, and a solar panel 250. The flagpole attachment member 230 couples with the middle shaft 202 via a threaded bolt 304 that passes through an opening in the flagpole attachment member 230 and also passes through an interior of the middle shaft 202. A nut 306 engages with the threads of the bolt 304 once the bolt 304 is positioned through both the flagpole attachment member 230 and the middle shaft 202 to hold the bolt 304 in place and thus secure the flagpole attachment member 230 to the middle shaft 202. A slot or channel 303 in the middle shaft 202 receives the bolt 304 to permit the bolt to enter the interior of the middle shaft 202. The flagpole attachment member 230 may thus be attached to the middle shaft 202 at an adjustable location at any position along the slot 303, allowing the flagpole attachment device to be mounted at a variety of locations along the mounting assembly 104. In another embodiment, a discrete hole or a plurality of discrete holes may be used to receive the bolt 304. In still another embodiment, the flagpole attachment member 230 may be attached via setscrews that secure the flagpole attachment member 230 to the middle shaft 202 without requiring any slot or channel or holes in the middle shaft 202.

The flagpole attachment member 230 includes a cavity, preferably cylindrical in shape, to accept the flagpole 110. The flagpole 110 slides within the cavity of the flagpole attachment member 230 and engages with an endcap or endpiece 308 of the flagpole attachment member 230. Alternatively, the endcap 308 may be of any shape or configuration or may screw onto the flagpole 110. In still another embodiment, the flagpole 110 may extend through the cavity of the flagpole attachment member 230 and rest on the base of the truck bed or fasten to an endcap or base that rests on the truck bed, as seen in more detail for FIG. 11. The endcap 308 includes a plurality of holes for accepting an endbolt or other fastener 309. The endbolt 309 is configured to pass through the holes of the endcap 308 and also pass through the flagpole 110, thus attaching the flagpole 110 to the flagpole receiving member 230. For further stability, the flagpole attachment member 230 preferably includes two setscrews 318 for pressing against the flagpole 110 when the flagpole 110 is positioned within the cavity of the flagpole attachment member 230. These setscrews 318 provide additional pressure points to help prevent movement of the flagpole 110 after it is positioned within the cavity of the flagpole attachment member 230.

The flagpole attachment member 230 also includes an opening 320 for receiving the light source 240. The light source 240 has a protruding element 322 for positioning within the opening 320 of the flagpole attachment member 230. The opening 320 of the flagpole attachment member 230 and the protrusion 322 of the light source 240 are preferably cylindrical or rounded in shape, permitting the light source 240 to be rotatably coupled to the flagpole attachment member 230. Hence, the light source 240 can be finely adjusted or directed as desired toward the flagpole 110 after the flagpole 110 has been received by the flagpole attachment member 230. The solar panel 250 is electrically connected with the light source 240 for providing power to the light source 240. Other aspects, components or features of the flagpole attachment member 230 mounting assembly 104 may be similar to the embodiments elsewhere described.

Figure 4:
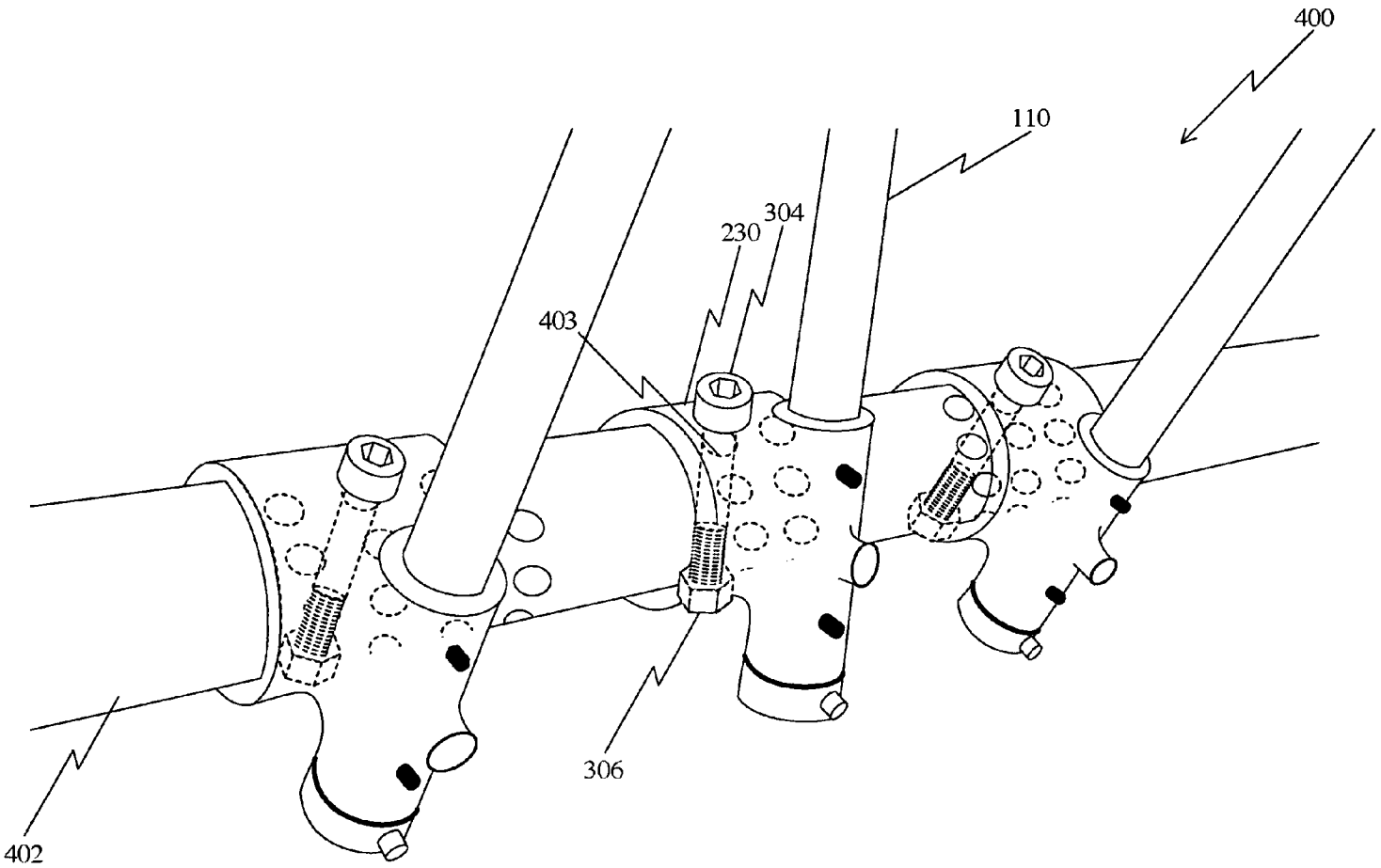
FIG. 4 is a zoomed perspective view of the flag and pole assembly shown in FIG. 1 according to an embodiment of the present invention.

FIG. 4 shows a zoomed perspective view of a middle shaft 402 of a mounting assembly 400 and demonstrates another embodiment for attaching a flagpole 110 to a vehicle. The middle shaft 402 couples with a flagpole attachment member 230. Similar to the mounting assembly 104 (see FIG. 3), the flagpole attachment member 230 is coupled to the middle shaft 402 with a threaded bolt 304 and a nut 306. However, instead of using a configuration like the slot 303 (see FIG. 3) to receive the bolt 304, the bolt 304 passes through one of a plurality of discrete holes 403 to enter an interior volume of the middle shaft 402. The plurality of discrete holes are disposed around a circumference of the middle shaft 402. The bolt 304 passes through the flagpole attachment member 230, through one of the discrete holes 403 of the middle shaft 402, through the interior volume of the middle shaft 402, through another one of the discrete holes 403 to exit the middle shaft 402 and finally through the flagpole attachment member 230 to engage with the nut 306 for tightening the flagpole attachment member 230 and the middle shaft 402 together. The plurality of discrete holes 403 are positioned both longitudinally along the middle shaft 402 and radially around a perimeter or circumference of the middle shaft 402. Thus, the flagpole attachment member 230 can be positioned at various locations along a central axis of the middle shaft 402 and is also rotatable around the outer circumference of the middle shaft 402. This configuration provides increased flexibility for the placement and orientation of any desired flagpoles 110 to be attached to the vehicle via the flagpole attachment member 230. Other aspects, components or features of the flagpole attachment member 230 or the mounting assembly 400 may be similar to the embodiments elsewhere described.

Figure 5:
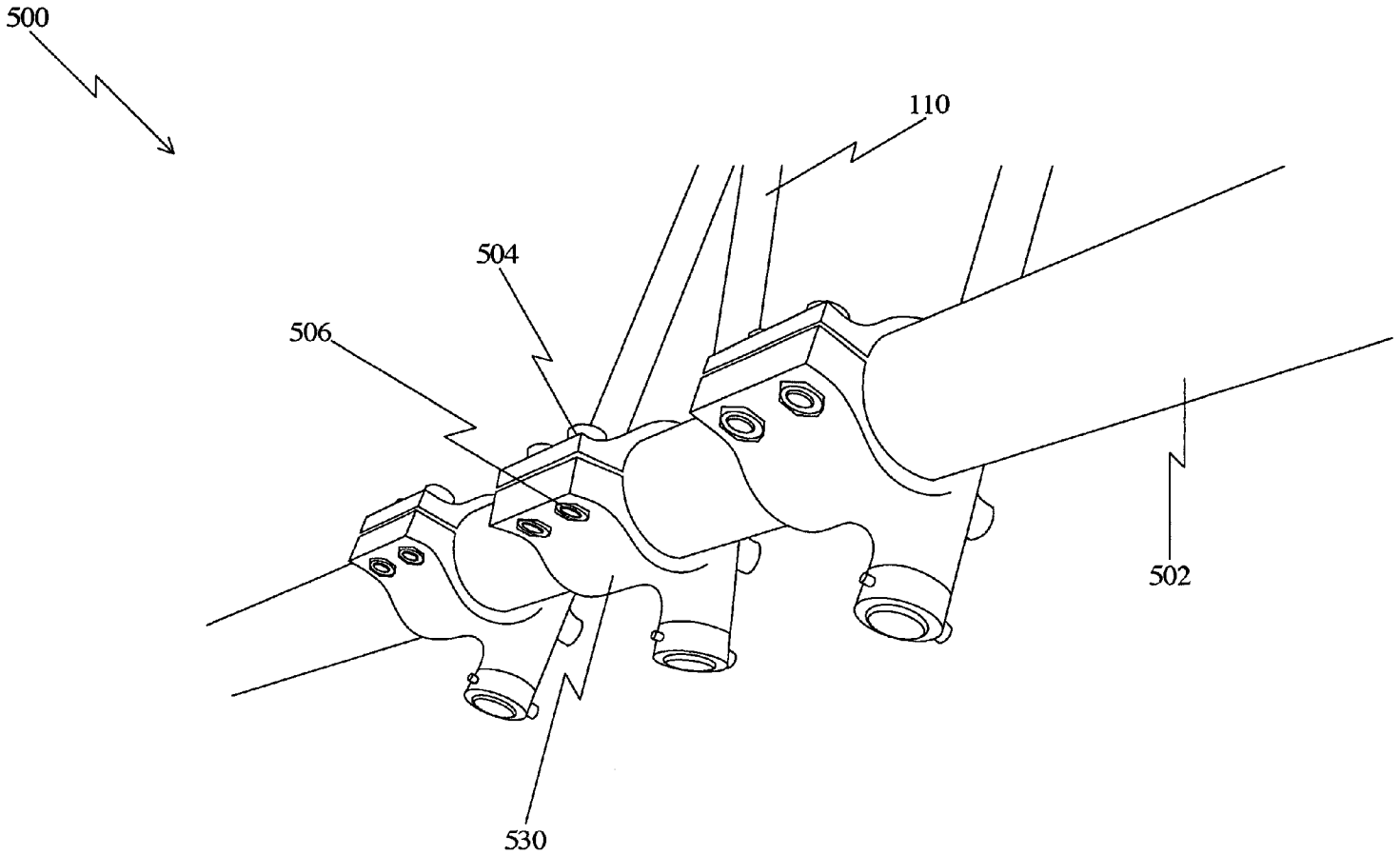
FIG. 5 is a zoomed perspective view of the flag and pole assembly shown in FIG. 1 according to an embodiment of the present invention.

In still another embodiment for attaching a flagpole to a vehicle, FIG. 5 shows a zoomed perspective view of a middle shaft 502 of a mounting assembly 500. The middle shaft 502 couples with a flagpole attachment member 530. The flagpole attachment member 530 uses a threaded bolt 504 and a nut 506 to couple the flagpole attachment member 530 to the middle shaft 502.

In contrast to the above described embodiments, the flagpole attachment member 530 fastens to the middle shaft 502 via a clamping configuration, wherein the bolt 504 does not enter or pass through the middle shaft 502. Instead, the bolt 504 only passes through two portions of the flagpole attachment member 530 that act as a clamp around the middle shaft 502. Hence, the two portions of the flagpole attachment member 530 are pulled towards each other by rotating the nut 506 along the bolt 504, thus tightening the flagpole attachment member 530 around the middle shaft 502. The middle shaft 502 of mounting assembly 500 can thus be manufactured without slots or discrete holes for accommodating any connecting components for the attachment of the flagpole attachment member 530. Other aspects, components or features of the flagpole attachment member 530 or the mounting assembly 500 may be similar to the embodiments elsewhere described.

Figure 6:
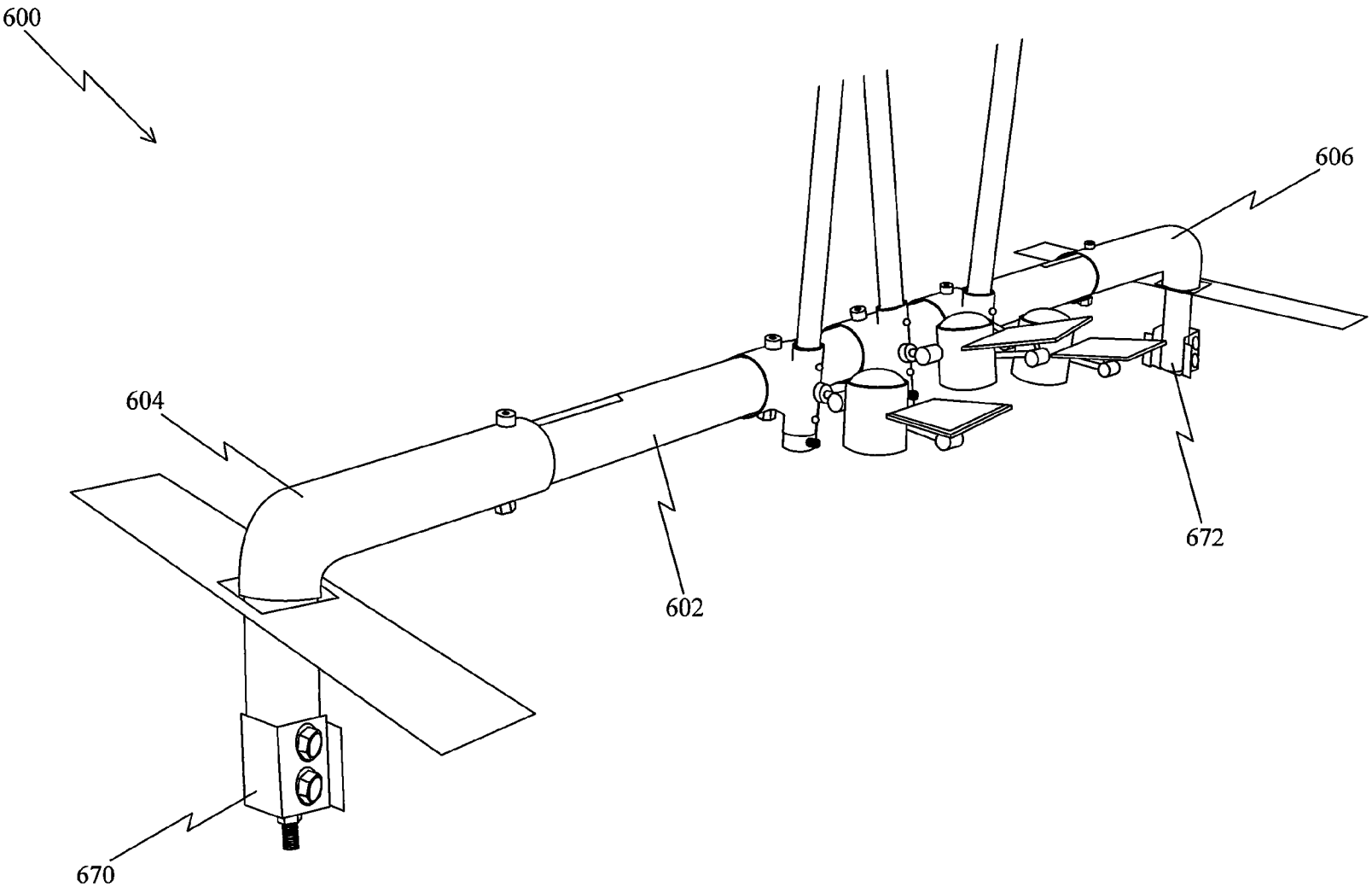
FIG. 6 is a perspective view of the flag and pole assembly shown in FIG. 1 according to an embodiment of the present invention.

Turning now to FIG. 6, a mounting assembly 600 is shown for attaching a flagpole to a vehicle. The mounting assembly 600 is similar to and may incorporate many of the same components or features as described above. However, mounting assembly 600 utilizes a first endshaft 604 and a second endshaft 606 that differ from those previously discussed (see FIG. 2). While the mounting assembly 104 (see FIG. 2) incorporated straight posts 270 and 272 that were coupled at a substantially 90 degree angle with first and second endshafts 204 and 206, the mounting assembly 600 has a first endshaft 604 and a second endshaft 606 with integrally formed curved portions that connect to posts with substantially no angle between the post and the endshaft at their coupling location.

The first endshaft 604 has an end portion and has a connecting portion that connects with a middle shaft 602 at a first portion of the middle shaft 602. The second endshaft 606 has an end portion and has a connecting portion that connects with the middle shaft 602 at a second portion of the middle shaft 602. The curved portion of the first endshafts 604 is formed between the connecting portion and the end portion of the first endshaft 604. Likewise, the curved portion of the second endshaft 606 is formed between the connecting portion and the end portion of the second endshaft 606. Each curved portion forms a substantially 90 degree curve. A first post 670 is coupled with the end portion of the first endshaft 604 and a second post 672 is coupled with the end portion of the second endshaft 606. The curved portions of the endshafts 604 and 606 provide an aesthetically pleasing look while also eliminating sharp edges that may otherwise be a safety concern for an assembly located on an exterior of a vehicle. Other aspects, components or features of the mounting assembly 600 may be similar to the embodiments elsewhere described.

Figure 7:
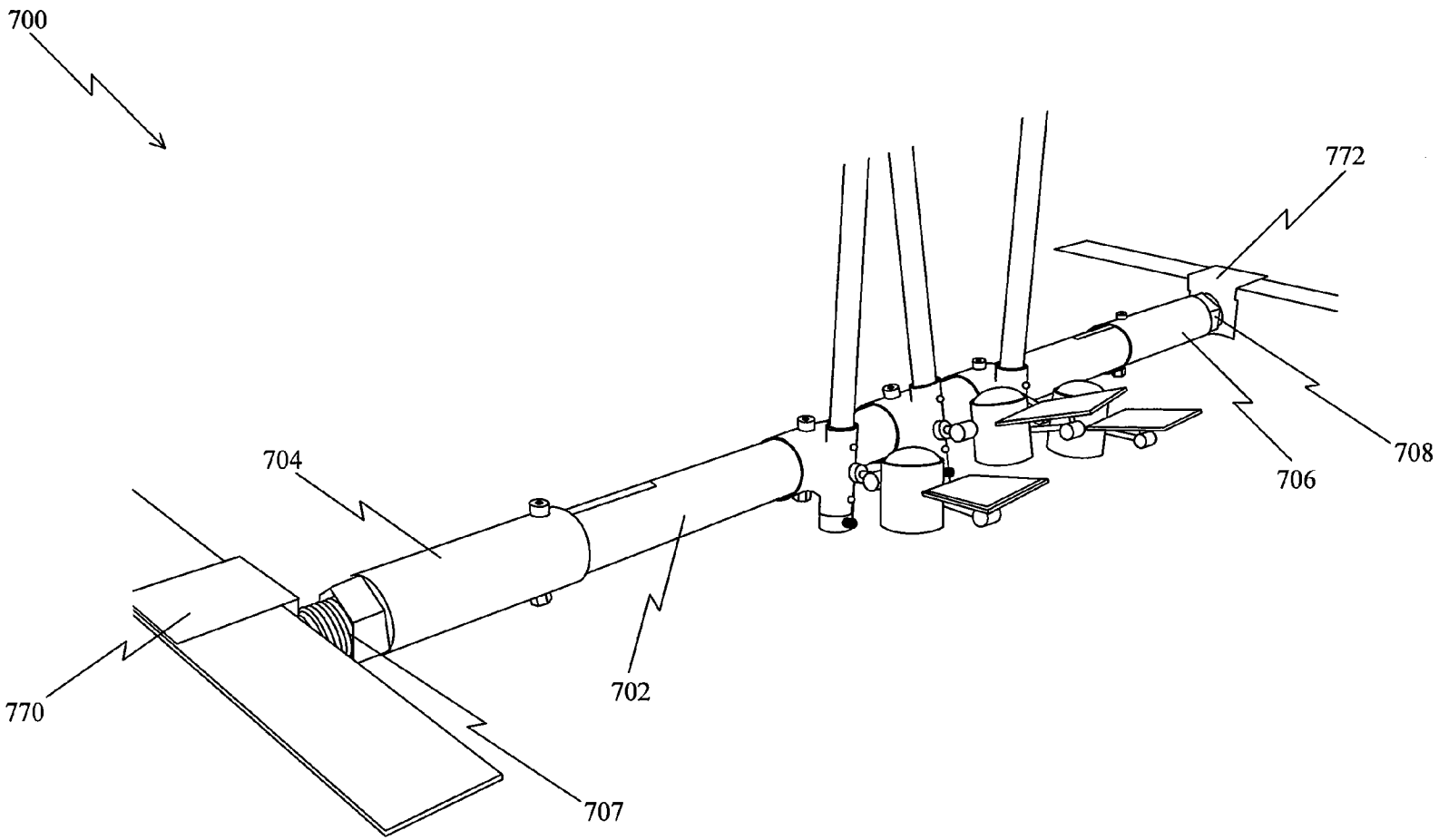
FIG. 7 is a perspective view of the flag and pole assembly shown in FIG. 1 according to an embodiment of the present invention.

Referring next to FIG. 7, a mounting assembly 700 is shown for attaching a flagpole to a vehicle. The mounting assembly 700 is similar to and may incorporate many of the same components or features as described above. However, mounting assembly 700 utilizes a different vehicle attachment method that does not require or depend upon stake pockets, in contrast to the embodiments previously discussed.

The mounting assembly 700 comprises a middle shaft 702 coupled to a first endshaft 704 and a second endshaft 706. The first or second endshafts 704 or 706 are adjustably connected to the middle shaft 702 in order to accommodate a variety of truck bed dimensions, as discussed above for FIG. 2. The first endshaft 704 rotatably engages with first threads of a first threaded component 707. The second endshaft 706 rotatably engages with first threads of a second threaded component 708. A first bracket 770 has a top portion that is configured to make contact with a top surface of the first sidewall 106 (see FIG. 1) and a second bracket 772 has a top portion that is configured to make contact with a top surface of the second sidewall 108 (see FIG. 1). The first bracket 770 also has a side portion that receives second threads of the first threaded component 707. Similarly, the second bracket 772 has a side portion that receives second threads of the second threaded component 708.

Rotating the first threaded component 707 or the second threaded component 708 provides an additional adjustment of the total length of the mounting assembly 700. For example, by rotating the first threaded component 707 in one direction, the first threads of the first threaded component will extend from the first endshaft 704 and the second threads of the first threaded component will extend from the first bracket 770, effectively increasing the total length of the mounting assembly 700. By rotating the first threaded component 707 in the opposite direction, the first threads of the first threaded component will retreat into the first endshaft 704 and the second threads of the first threaded component will retreat into the first bracket 770. The second threaded component 708 operates in a similar manner. Other aspects, components or features of the mounting assembly 700 may be similar to the embodiments elsewhere described.

Figure 8:
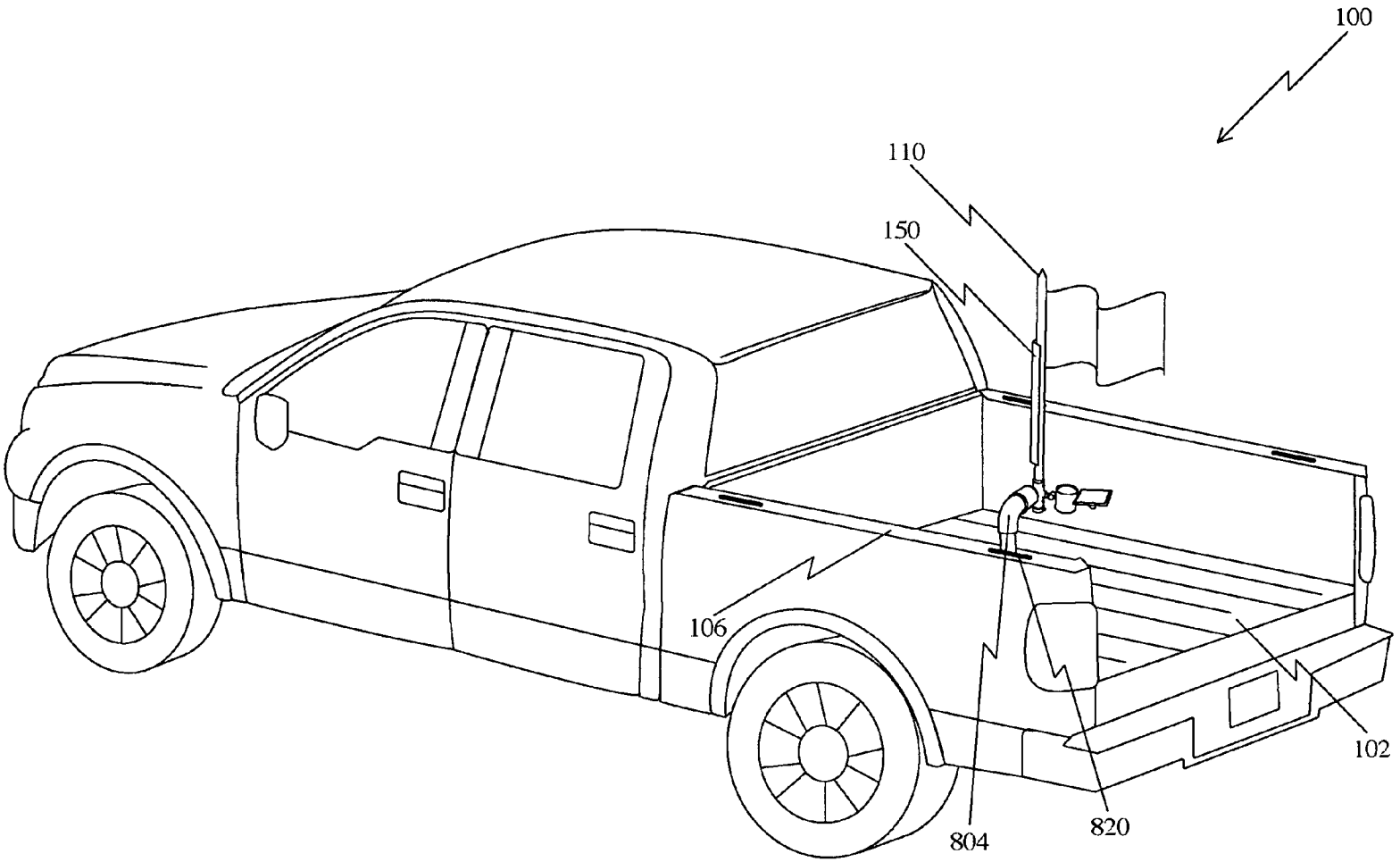
FIG. 8 is a view of a truck having a flag and pole assembly mounted on one side of a truck bed according to an embodiment of the present invention.

An alternative flag and pole mounting assembly 804 is shown in FIG. 8 mounted on a truck 100 with a flagpole 110 coupled thereto. Similar to FIG. 1, the truck 100 includes a truck bed 102 partly defined by two sidewalls positioned along two outer edges of the truck bed 102. The flag and pole mounting assembly 804 for receiving the flagpole 110 is positioned near one sidewall 106. The sidewall 106 contains a stake pocket 820. The flag and pole mounting assembly 804 is coupled to the sidewall 106 as discussed in greater detail herein. Hence, the flagpole 110 is secured or attached to the truck 100 via the flag and pole mounting assembly 804. While the truck 100 is shown as a preferred embodiment, in another embodiment a different type of motor vehicle (car, boat, etc.) or other mobile or stationary structure may accommodate the flag and pole mounting assembly 804 for attaching the flagpole 110 thereto. Furthermore, other objects may be mounted in place of or in addition to flagpoles (e.g., light vehicles, animals, fishing equipment). Additionally, a wind deflector 150 having a wedged shape couples to the flagpole 110 for directing or controlling a flow of air around the flagpole 110 to better increase stability when the truck 100 is in motion. The wind deflector 150 may be formed of various shapes or sizes or fasten to the flag and pole mounting assembly 804 instead of the flagpole 110 in alternative embodiments. In still another embodiment, the wind deflector 150 may not be included in order to reduce drag forces, depending on the angle of the flagpole 110.

Figure 9:
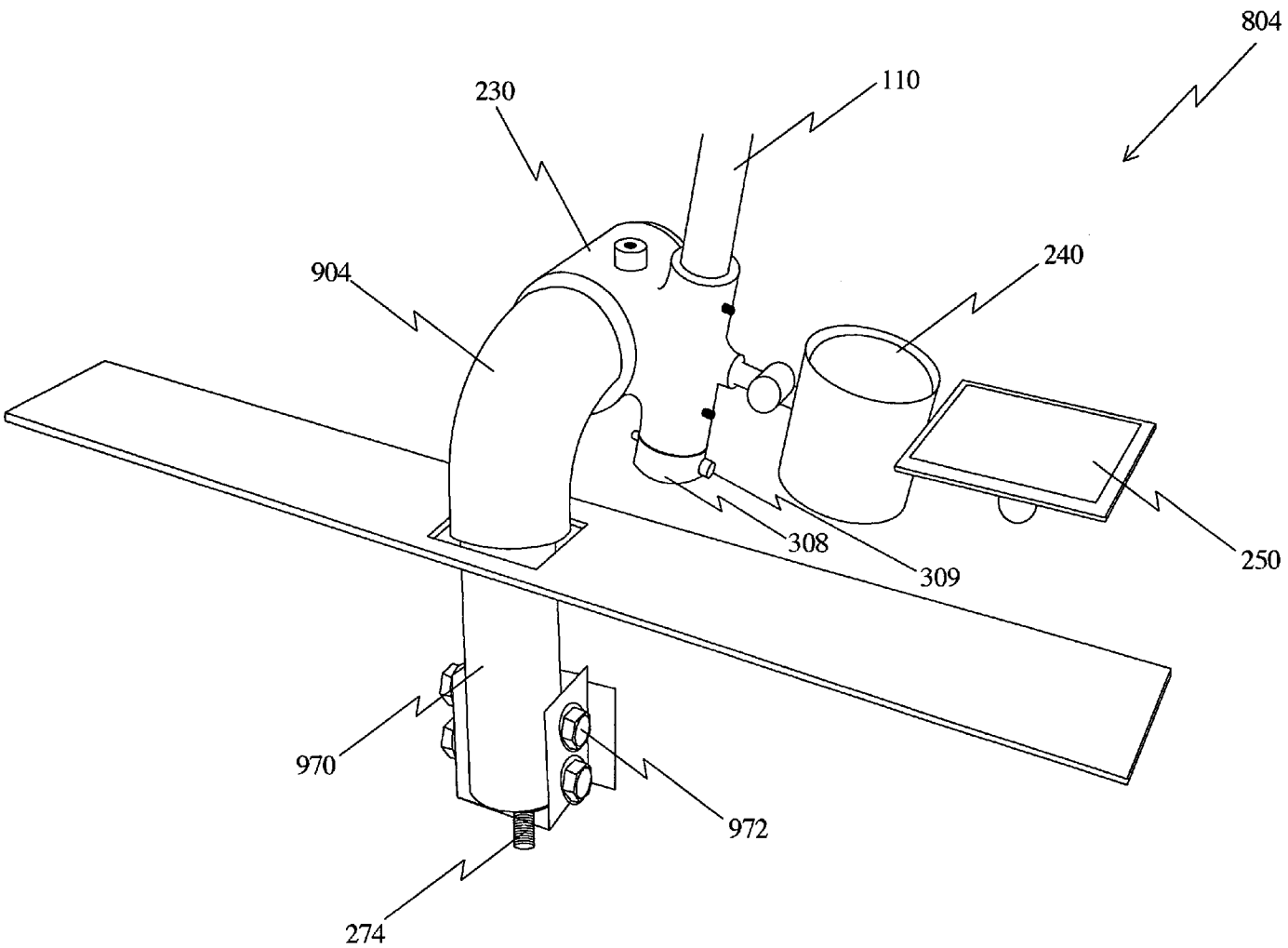
FIG. 9 is a perspective view of the flag and pole assembly shown in FIG. 8 according to an embodiment of the present invention.

FIG. 9 shows a perspective view of a mounting assembly 804. The mounting assembly 804 is preferably configured for attachment to a truck 100 at one stake pocket 820 (see FIG. 8). A flagpole attachment member 230 is coupled to a shaft 904. The shaft 904 is curved and operates to offset the connection location of the flagpole attachment member 230 from directly above the stake pocket 820 (see FIG. 8). The flagpole attachment member 230 is similar to those embodiments discussed above and couples to the shaft 904 by similar methods. The flagpole attachment member 230 preferably contains a cavity for receiving a flagpole 110 and incorporates an endcap 308 and an endbolt 309 to secure the flagpole 110 within the cavity, as discussed in greater detail above. In addition, a light source 240 electrically connected with a solar panel 250 is preferably coupled to the flagpole attachment member 230 as discussed in greater detail above.

With reference to FIG. 8, instead of extending across the bed of a truck, the mounting assembly 804 utilizes only one stake pocket 820 for securing the flagpole 110 to the vehicle 100. A post 970, coupled to the shaft 940, is configured to be received by the stake pocket 820. When the post 970 is positioned within the stake pocket 820, the post 970 is configured to couple with the interior surface or component of the sidewall 106 via bolts or other fasteners 972 and 274 for increased stability. Other aspects, components or features of the mounting assembly 804 may be similar to the embodiments elsewhere described.

Figure 10:
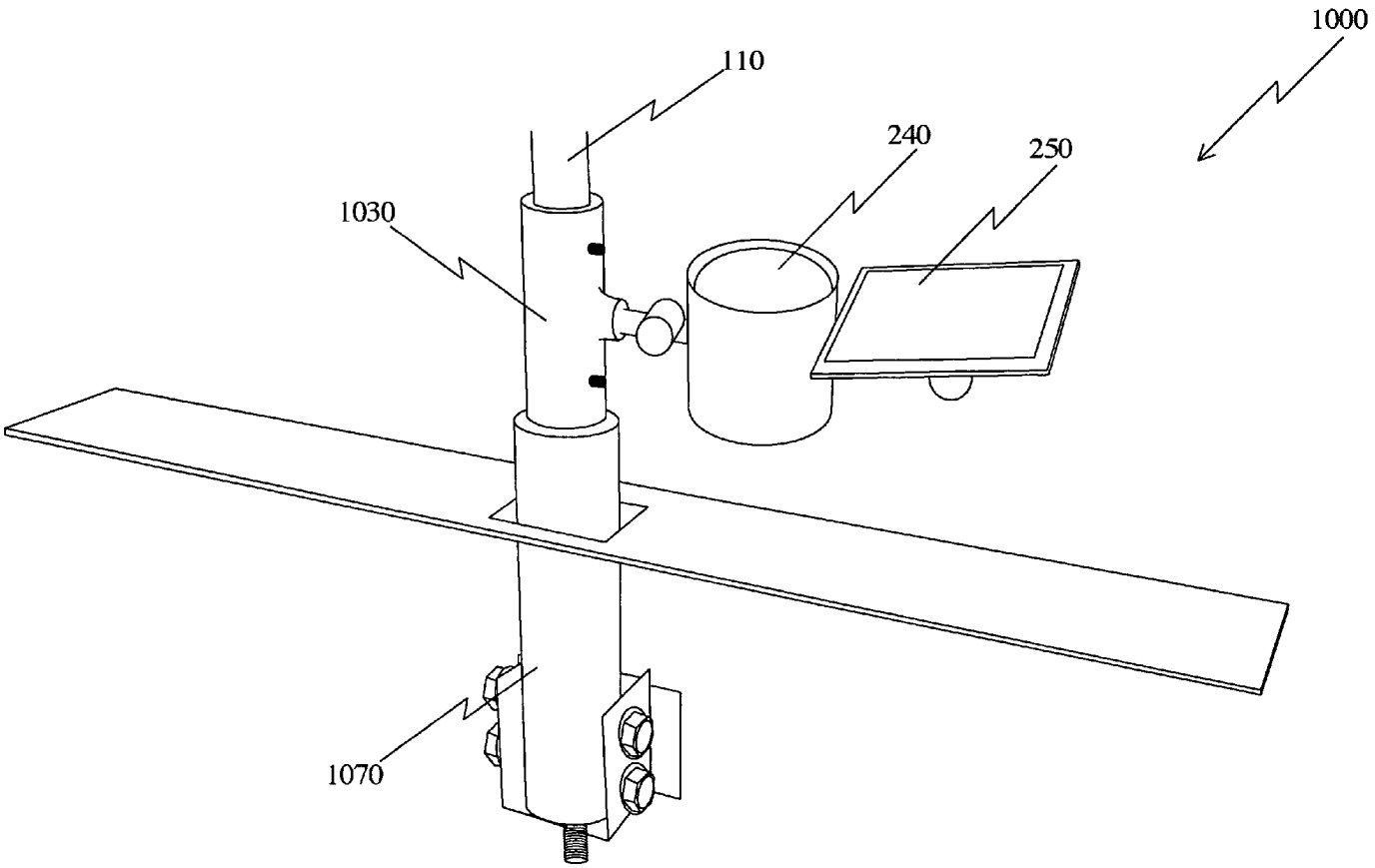
FIG. 10 is a perspective view of the flag and pole assembly shown in FIG. 8 according to an embodiment of the present invention.

FIG. 10 shows a perspective view of a mounting assembly 1000. The mounting assembly 1000 incorporates a flagpole attachment member 1030 that differs from those previously discussed since the flagpole attachment member 1030 is configured to mount directly to a post 1070 to be received within the stake pocket 820 of the sidewall 106 (see FIG. 8). Other features or aspects of the flagpole attachment member 1030 may be similar to those discussed above. The flagpole attachment member 1030 preferably contains a cavity for receiving a flagpole 110, as discussed in greater detail above. In addition, a light source 240 electrically connected with a solar panel 250 is preferably coupled to the flagpole attachment member 1030 as discussed in greater detail above. When the post 1070 is positioned within the stake pocket 820, the post 1070 is configured to couple with the interior surface or component of the sidewall 106 via bolts or other fasteners as described above for increased stability. Other aspects, components or features of the mounting assembly 1000 may be similar to the embodiments elsewhere described.

Figure 11:
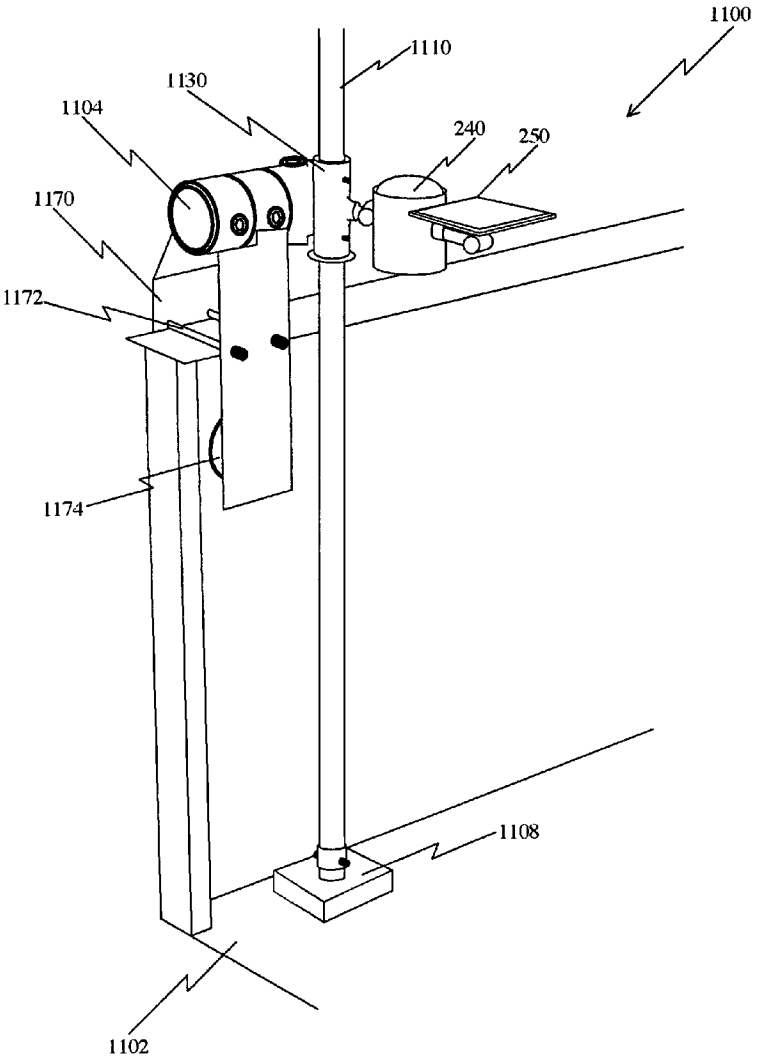
FIG. 11 is a perspective view of an embodiment of a flag and pole assembly mounted on a truck without the use of a stake pocket according to an embodiment of the present invention.

FIG. 11 shows a perspective view of a mounting assembly 1100 that fastens to the back or sidewalls of a truck, but does not utilize stake pockets. Instead, the mounting assembly 1100 utilizes clamping arms 1170 for coupling the mounting assembly 1100 to the truck or other vehicle. Weights or contacting members 1174 coated with a gripping material (e.g., rubber) grip a portion of the body of the truck when screws or bolts 1172 are tightened to secure the clamping arms 1170 around a portion of the truck or vehicle. A flagpole attachment member 1130 couples to clamping arms 1170 by a shaft or other linking component 1104. In an alternative embodiment, the clamping arms 1170 may be staggered along the length of the shaft 1104. In still another embodiment, additional clamping arms 1170 may be positioned along the length of shaft 1104 to provide further contact points with the truck or vehicle to increase stability of the mounting assembly 1100. Certain features or aspects of the flagpole attachment member 1130 may be similar to those discussed above. A light source 240 electrically connected with a solar panel 250 is preferably coupled with the flagpole attachment member 1130 as discussed in greater detail above.

The flagpole attachment member 1130 preferably contains a cavity for receiving a flagpole 1110, as discussed in greater detail above. The flagpole 1110 extends through the flagpole attachment member 1130 and engages with a base 1108 positioned on the truck bed 1102. The flagpole 1110 may be screwed or bolted to the base 1108 as shown, or alternatively may screw or otherwise engage with a portion of the base 1108. The base 1108 may rest on the truck bed without any fastening elements or it may be secured by bolts, adhesives, etc. In an alternative embodiment, the base 1108 may not be needed and an endcap of the flagpole attachment member 1130 may be used to stabilize the flagpole 1110 when it is positioned within the flagpole attachment member 1130. Other aspects, components or features of the mounting assembly 1100 may be similar to the embodiments elsewhere described.

Although the above described embodiments showcase varying features, components or attachment mechanisms, it is to be understood that the same or similar features, components or attachment mechanisms present for one embodiment may be incorporated into the other described embodiments as desired. In addition, the mounting assemblies above described may be designed or configured for a variety of objects to be mounted or secured to a truck in place of or in addition to flag attachment, for example light vehicles (e.g. bicycles, motorcycles, ATVs, etc.), pets (e.g. dogs), or fishing rods or equipment.

Exemplary embodiments of the invention have been disclosed in an illustrative style. Accordingly, the terminology employed throughout should be read in a non-limiting manner. Although minor modifications to the teachings herein will occur to those well versed in the art, it shall be understood that what is intended to be circumscribed within the scope of the patent warranted hereon are all such embodiments that reasonably fall within the scope of the advancement to the art hereby contributed, and that that scope shall not be restricted, except in light of the appended claims and their equivalents.

What is claimed is:

1. A flag and pole mounting assembly for attaching a flagpole to a vehicle, the vehicle having a first sidewall defining a first stake pocket and a second sidewall defining a second stake pocket, the mounting assembly comprising:

a middle shaft having a first portion and a second portion, the middle shaft configured to extend substantially between the first sidewall and the second sidewall of the vehicle;

a flagpole attachment member coupled to the middle shaft between the first portion and the second portion, the flagpole attachment member defining an opening for receiving the flagpole;

a first endshaft having a connecting portion coupled to the first portion of the middle shaft and an end portion;

a second endshaft having a connecting portion coupled to the second portion of the middle shaft and an end portion;

a first post coupled to the end portion of the first endshaft, the first post configured to engage with the first stake pocket of the first sidewall of the vehicle;

a second post coupled to the end portion of the second endshaft, the second post configured to engage with the second stake pocket of the second sidewall of the vehicle;

wherein the connecting portion of the first endshaft is adjustably coupled to the first portion of the middle shaft for adjusting a distance between the first post and the second post;

wherein the connecting portion of the first endshaft slidably engages with the first portion of the middle shaft;

a slot disposed substantially along the first portion of the middle shaft; and a fastening element coupled to the connecting portion of the first endshaft, the fastening element received by the slot.

2. A flag and pole mounting assembly for attaching a flagpole to a vehicle, the vehicle having a first sidewall defining a first stake pocket and a second sidewall defining a second stake pocket, the mounting assembly comprising:

a middle shaft having a first portion and a second portion, the middle shaft configured to extend substantially between the first sidewall and the second sidewall of the vehicle;

a flagpole attachment member coupled to the middle shaft between the first portion and the second portion, the flagpole attachment member defining an opening for receiving the flagpole;

a first endshaft having a connecting portion coupled to the first portion of the middle shaft and an end portion;

a second endshaft having a connecting portion coupled to the second portion of the middle shaft and an end portion;

a first post coupled to the end portion of the first endshaft, the first post configured to engage with the first stake pocket of the first sidewall of the vehicle;

a second post coupled to the end portion of the second endshaft, the second post configured to engage with the second stake pocket of the second sidewall of the vehicle;

wherein the connecting portion of the first endshaft is adjustably coupled to the first portion of the middle shaft for adjusting a distance between the first post and the second post;

wherein the connecting portion of the first endshaft slidably engages with the first portion of the middle shaft;

a plurality of holes disposed substantially along the first portion of the middle shaft; and a fastening element coupled to the connecting portion of the first endshaft, the fastening element received by at least one of the plurality of holes.

3. A flag and pole mounting assembly for attaching a flagpole to a vehicle, the vehicle having a first sidewall defining a first stake pocket and a second sidewall defining a second stake pocket, the mounting assembly comprising:

a middle shaft having a first portion and a second portion, the middle shaft configured to extend substantially between the first sidewall and the second sidewall of the vehicle;

a flagpole attachment member coupled to the middle shaft between the first portion and the second portion, the flagpole attachment member defining an opening for receiving the flagpole;

a first endshaft having a connecting portion coupled to the first portion of the middle shaft and an end portion;

a second endshaft having a connecting portion coupled to the second portion of the middle shaft and an end portion;

a first post coupled to the end portion of the first endshaft, the first post configured to engage with the first stake pocket of the first sidewall of the vehicle;

a second post coupled to the end portion of the second endshaft, the second post configured to engage with the second stake pocket of the second sidewall of the vehicle; and wherein the flagpole attachment member substantially surrounds a perimeter of the middle shaft and further comprising a fastening element that passes through the flagpole attachment member and an interior of the middle shaft for coupling the flagpole attachment member to the middle shaft.

4. A flag and pole mounting assembly for attaching a flagpole to a vehicle, the vehicle having a first sidewall defining a first stake pocket and a second sidewall defining a second stake pocket, the mounting assembly comprising:

a middle shaft having a first portion and a second portion, the middle shaft configured to extend substantially between the first sidewall and the second sidewall of the vehicle;

a flagpole attachment member coupled to the middle shaft between the first portion and the second portion, the flagpole attachment member defining an opening for receiving the flagpole;

a first endshaft having a connecting portion coupled to the first portion of the middle shaft and an end portion;

a second endshaft having a connecting portion coupled to the second portion of the middle shaft and an end portion;

a first post coupled to the end portion of the first endshaft, the first post configured to engage with the first stake pocket of the first sidewall of the vehicle;

a second post coupled to the end portion of the second endshaft, the second post configured to engage with the second stake pocket of the second sidewall of the vehicle; and wherein the flagpole attachment member substantially surrounds a perimeter of the middle shaft and further comprising a fastening element that passes through the flagpole attachment member and does not pass through an interior of the middle shaft for coupling the flagpole attachment member to the middle shaft.

5. A flag and pole mounting assembly for attaching a flagpole to a vehicle, the vehicle having a first sidewall defining a first stake pocket and a second sidewall defining a second stake pocket, the mounting assembly comprising:

a middle shaft having a first portion and a second portion, the middle shaft configured to extend substantially between the first sidewall and the second sidewall of the vehicle;

a flagpole attachment member coupled to the middle shaft between the first portion and the second portion, the flagpole attachment member defining an opening for receiving the flagpole; and wherein the flagpole attachment member is adjustably positioned along a length of the middle shaft between the first portion and the second portion of the middle shaft.

6. The mounting assembly of claim 5 further comprising:

a first endshaft having a connecting portion coupled to the first portion of the middle shaft and an end portion;

a second endshaft having a connecting portion coupled to the second portion of the middle shaft and an end portion;

a first post coupled to the end portion of the first endshaft, the first post configured to engage with the first stake pocket of the first sidewall of the vehicle; and a second post coupled to the end portion of the second endshaft, the second post configured to engage with the second stake pocket of the second sidewall of the vehicle.

7. The mounting assembly of claim 6 further comprising:

a second flagpole attachment member coupled to the middle shaft between the first portion and the second portion, the second flagpole attachment member defining an opening for receiving the flagpole;

a third flagpole attachment member coupled to the middle shaft between the first portion and the second portion the third flagpole attachment member defining an opening for receiving the flagpole; and a light source adjustably coupled to any of the flagpole attachment member, the second flagpole attachment member or the third flagpole attachment member.

8. A flag and pole mounting assembly for attaching a flagpole to a vehicle, the vehicle having a first sidewall defining a first stake pocket and a second sidewall defining a second stake pocket, the mounting assembly comprising:

a middle shaft having a first portion and a second portion, the middle shaft configured to extend substantially between the first sidewall and the second sidewall of the vehicle;

a flagpole attachment member coupled to the middle shaft between the first portion and the second portion, the flagpole attachment member defining an opening for receiving the flagpole; and wherein the flagpole attachment member is adjustably oriented around a perimeter of the middle shaft between the first portion and the second portion of the middle shaft.

9. The mounting assembly of claim 8 further comprising:

a first endshaft having a connecting portion coupled to the first portion of the middle shaft and an end portion;

a second endshaft having a connecting portion coupled to the second portion of the middle shaft and an end portion;

a first post coupled to the end portion of the first endshaft, the first post configured to engage with the first stake pocket of the first sidewall of the vehicle; and a second post coupled to the end portion of the second endshaft, the second post configured to engage with the second stake pocket of the second sidewall of the vehicle.

10. The mounting assembly of claim 9 further comprising:

a second flagpole attachment member coupled to the middle shaft between the first portion and the second portion, the second flagpole attachment member defining an opening for receiving the flagpole;

a third flagpole attachment member coupled to the middle shaft between the first portion and the second portion the third flagpole attachment member defining an opening for receiving the flagpole; and a light source adjustably coupled to any of the flagpole attachment member, the second flagpole attachment member or the third flagpole attachment member.

11. A flag and pole mounting assembly for attaching a flagpole to a vehicle, the vehicle having a first sidewall and a second sidewall, the mounting assembly comprising:

a middle shaft having a first portion and a second portion, the middle shaft configured to extend substantially between the first sidewall and the second sidewall of the vehicle;

a first endshaft having a connecting portion coupled to the first portion of the middle shaft and an end portion;

a first threaded component engaged with the end portion of the first endshaft;

a second endshaft having a connecting portion coupled to the second portion of the middle shaft and an end portion;

a second threaded component engaged with the end portion of the second endshaft;

a first bracket engaged with the first threaded component and configured to contact the first sidewall of the vehicle;

a second bracket engaged with the second threaded component and configured to contact the second sidewall of the vehicle; and a flagpole attachment member coupled to the middle shaft between the first portion and the second portion, the flagpole attachment member defining an opening for receiving the flagpole.

12. The mounting assembly of claim 11 wherein the first threaded component is configured to rotate within the first bracket and within the end portion of the first endshaft for increasing or decreasing a distance between the end portion of the first endshaft and the first sidewall of the vehicle; and wherein the second threaded component is configured to rotate within the second bracket and within the end portion of the second endshaft for increasing or decreasing a distance between the end portion of the second endshaft and the second sidewall of the vehicle.

13. The mounting assembly of claim 11 wherein the middle shaft is substantially cylindrical.

14. The mounting assembly of claim 11 wherein the flagpole attachment member defines a second opening and further comprising a light source for illuminating the flagpole, the light source having a protrusion adjustably received by the second opening of the flagpole attachment member.

15. The mounting assembly of claim 14 further comprising a solar panel electrically connected to the light source for powering the light source.

16. The mounting assembly of claim 14 wherein the light source is configured to be powered by an existing electrical system of the vehicle.

* * * * *